US011476606B2

(12) United States Patent
Chen

(10) Patent No.: US 11,476,606 B2
(45) Date of Patent: Oct. 18, 2022

(54) FLOATING CONNECTOR WITH POWER ELECTRODE STRUCTURE

(71) Applicant: P-TWO INDUSTRIES INC., Taoyuan (TW)

(72) Inventor: Pi-Miao Chen, Taoyuan (TW)

(73) Assignee: P-TWO INDUSTRIES INC., Taoyuan (TW)

( * ) Notice: Subject to any disclaimer, the term of this patent is extended or adjusted under 35 U.S.C. 154(b) by 58 days.

(21) Appl. No.: 17/185,904

(22) Filed: Feb. 25, 2021

(65) Prior Publication Data

US 2022/0158375 A1 May 19, 2022

(30) Foreign Application Priority Data

Nov. 16, 2020 (TW) ..... 109140268

(51) Int. Cl.

| | |
|---|---|
| ***H01R 12/71*** | (2011.01) |
| ***H01R 12/91*** | (2011.01) |
| ***H01R 12/70*** | (2011.01) |
| ***H01R 13/04*** | (2006.01) |
| ***H01R 13/10*** | (2006.01) |
| ***H01R 13/502*** | (2006.01) |

(52) U.S. Cl.

CPC ..... *H01R 12/91* (2013.01); *H01R 12/7005* (2013.01); *H01R 12/716* (2013.01); *H01R 13/04* (2013.01); *H01R 13/10* (2013.01); *H01R 13/502* (2013.01)

(58) Field of Classification Search

CPC .. H01R 12/91; H01R 12/7005; H01R 12/716; H01R 13/04; H01R 13/10; H01R 13/502; H01R 12/73; H01R 13/6315; H01R 12/721

See application file for complete search history.

(56) References Cited

U.S. PATENT DOCUMENTS

| | | | | |
|---|---|---|---|---|
| 9,761,975 | B1 * | 9/2017 | Wang | H01R 12/79 |
| 10,199,761 | B1 * | 2/2019 | Kuo | H01R 12/91 |
| 10,931,045 | B2 * | 2/2021 | Aoki | H01R 12/737 |
| 10,950,978 | B2 * | 3/2021 | Shioda | H01R 13/112 |
| 11,349,240 | B2 * | 5/2022 | Yoshida | H01R 12/91 |
| 2007/0202729 | A1 * | 8/2007 | Uesaka | H01R 13/41 439/248 |
| 2011/0294326 | A1 * | 12/2011 | Tanaka | H01R 13/6315 439/248 |
| 2012/0003875 | A1 * | 1/2012 | Akai | H01R 13/506 439/660 |

(Continued)

*Primary Examiner* — Abdullah A Riyami
*Assistant Examiner* — Nelson R. Burgos-Guntin
(74) *Attorney, Agent, or Firm* — Fei-Hung Yang

(57) ABSTRACT

The invention provides a floating connector with a power electrode structure, which includes a plug and a socket. The plug includes a plug base body, a connector, a first signal terminal group, a first power terminal group and a fixing member. The socket includes a socket upper shell, a socket lower shell, a connecting slot, a second signal terminal group, a second power terminal group, a fixer and a tongue plate. When the plug is inserted into the socket, the first signal terminal group is electrically connected to the second signal terminal group and the first power terminal group is electrically connected to the second power terminal group, between the connector and the connecting groove, for transmitting power and signals.

6 Claims, 10 Drawing Sheets

(56) References Cited

U.S. PATENT DOCUMENTS

2014/0213115 A1* 7/2014 Kimura ..... H01R 24/60 439/629
2015/0024620 A1* 1/2015 Kobayashi ..... H01R 12/91 439/345
2015/0044901 A1* 2/2015 Doi ..... H01R 12/716 439/592
2015/0044917 A1* 2/2015 Takaki ..... H01R 13/52 439/733.1
2015/0044919 A1* 2/2015 Kimura ..... H01R 12/85 439/862
2015/0132998 A1* 5/2015 Sato ..... H01R 13/6315 439/676
2015/0132999 A1* 5/2015 Sato ..... H01R 13/6315 439/676
2015/0270658 A1* 9/2015 Aoki ..... H01R 13/6461 439/660
2016/0294111 A1* 10/2016 Kobayashi ..... H01R 12/716
2016/0308311 A1* 10/2016 Hori ..... H01R 12/91
2017/0141496 A1* 5/2017 Kiryu ..... H01R 12/72
2017/0264032 A1* 9/2017 Ninomiya ..... H01R 13/6315
2018/0138618 A1* 5/2018 Hasegawa ..... H01R 13/405
2018/0145467 A1* 5/2018 Doi ..... H01R 12/73
2018/0287301 A1* 10/2018 Tanaka ..... H01R 4/028
2018/0337482 A1* 11/2018 Teruki ..... H01R 13/506
2019/0013608 A1* 1/2019 Yoshida ..... H01R 13/631
2019/0020134 A1* 1/2019 Suzuki ..... H01R 12/55
2019/0052005 A1* 2/2019 Hasegawa ..... H01R 13/405
2019/0229455 A1* 7/2019 Shimoji ..... H01R 12/91
2019/0334267 A1* 10/2019 Hashiguchi ..... H01R 12/7082
2019/0334288 A1* 10/2019 Horii ..... H01R 13/24
2019/0348782 A1* 11/2019 Horii ..... H01R 12/727
2020/0052424 A1* 2/2020 Aoki ..... H01R 13/642
2020/0052440 A1* 2/2020 Hashiguchi ..... H01R 13/6315
2020/0083642 A1* 3/2020 Chen ..... H01R 12/7005
2020/0083643 A1* 3/2020 Hashiguchi ..... H01R 12/91
2020/0112113 A1* 4/2020 Aoki ..... H01R 12/716
2020/0295511 A1* 9/2020 Shioda ..... H01R 12/91
2021/0384663 A1* 12/2021 Miyamoto ..... H01R 12/73

* cited by examiner

FLOATING CONNECTOR WITH POWER ELECTRODE STRUCTURE

CROSS-REFERENCE TO RELATED APPLICATIONS

This non-provisional application claims priority under 35 U.S.C. § 119(a) on Patent Application No(s). 109140268 filed in Taiwan, R.O.C. on Nov. 16, 2020, the entire contents of which are hereby incorporated by reference.

BACKGROUND

Technical Field

The present invention relates to the technical field of connectors. More particularly, the present invention relates to a floating connector with a power electrode structure which includes a signal terminal and a power terminal.

Description of Related Art

In general, a conventional connector includes a plug and a socket, and the plug and socket are connected to each other, so that a plurality of terminals in the plug and socket can be electrically coupled to one another to transmit signals or power.

In some applications, the space between the plug and socket is small, and the power and signals are situated in the plug and socket; but when the plug and socket transmit power or signals at the same time, the signals may be interfered by the power, so as to affect the quality of the signals. Furthermore, it is very difficult to precisely align the plug and socket with each other during their connection since the installation space is small and the connector is usually miniaturized.

In view of the aforementioned drawbacks, the present invention provides a floating connector with a power electrode structure to overcome the drawback of the conventional connectors.

SUMMARY

Therefore, it is a first objective of the present disclosure to provide a floating connector with a power electrode structure which has a plug and a socket that can be connected with each other easily.

A second objective of the present invention is based on the aforementioned floating connector with a power electrode structure to provide the function of transmitting both power and signal simultaneously in a same accommodating space.

A third objective of the present invention is based on the aforementioned floating connector with a power electrode structure to provide a floating structure in the socket to achieve the effect of aligning with the socket precisely without requiring the plug.

A fourth objective of the present invention is based on the aforementioned floating connector with a power electrode structure to provide an engaging slot for connecting a cover in order to provide the dustproof and waterproof effects when the plug and socket are not connected with each other.

To achieve the aforementioned and other objectives, the present invention discloses a floating connector with a power electrode structure comprising a plug and a socket. The plug comprises a plug base body, a connector, a first signal terminal group, a first power terminal group and a fixing member. The plug base body is coupled to the connector to form an accommodating space. The first signal terminal group and the first power terminal group are installed at the periphery of the inner wall of the accommodating space. The first power terminal group is installed on both sides of the first signal terminal group. The fixing member is provided for installing the plug base body to a first circuit board. The socket comprises a socket upper shell, a socket lower shell, a connecting groove, a second signal terminal group, a second power terminal group, a fixer and a tongue plate. The socket upper shell is coupled to the socket lower shell. The connecting groove is configured to be corresponsive to the connector. The connecting groove is formed on the socket upper shell for accommodating the tongue plate. The second signal terminal group and the second power terminal group are installed on both sides of the tongue plate respectively. The fixer the fixer is provided for limiting the position of the socket upper shell to the socket lower shell, and the second signal terminal group between the socket upper shell and the socket lower shell is deformed towards at least one direction selected from a first direction and a second direction to produce a movement. Wherein, when the plug is inserted into the socket, the first signal terminal group is electrically coupled to the second signal terminal group and the first power terminal group is electrically coupled to the second power terminal group, between the connector and the connecting groove, for transmitting power and signals.

Compared with the prior art, the floating connector with a power electrode structure in accordance with the present invention can transmit both signal and power at the same time, while allowing the plug and the socket to be connected with each other easily.

DESCRIPTION OF THE EMBODIMENTS

The accompanying drawings are included to provide a further understanding of the disclosure, and are incorporated in and constitute a part of this specification. The drawings illustrate embodiments of the disclosure and, together with the description, serve to explain the principles of the disclosure.

In this invention, the terms "a" and "one" are used as a unit, an element and a component for the description of this specification to facilitate the description and provide a general meaning to the scope of the invention, so that both "a" and "one" refer to one or at least one including an odd or even number, unless otherwise specified.

In this invention, the terms "comprising", "including", "having" "containing" or any other similar terminologies intend to cover non-exclusive contents. For example, the invention comprising an element of a plurality of elements, structures, products, or devices is not limited to the elements listed in the specification only, but also including other usually inherent elements, structures, products or devices which are not listed specifically. Unless otherwise specified, the term "or" refers to the inclusive "or", but not the exclusive "or".

Figure 1:
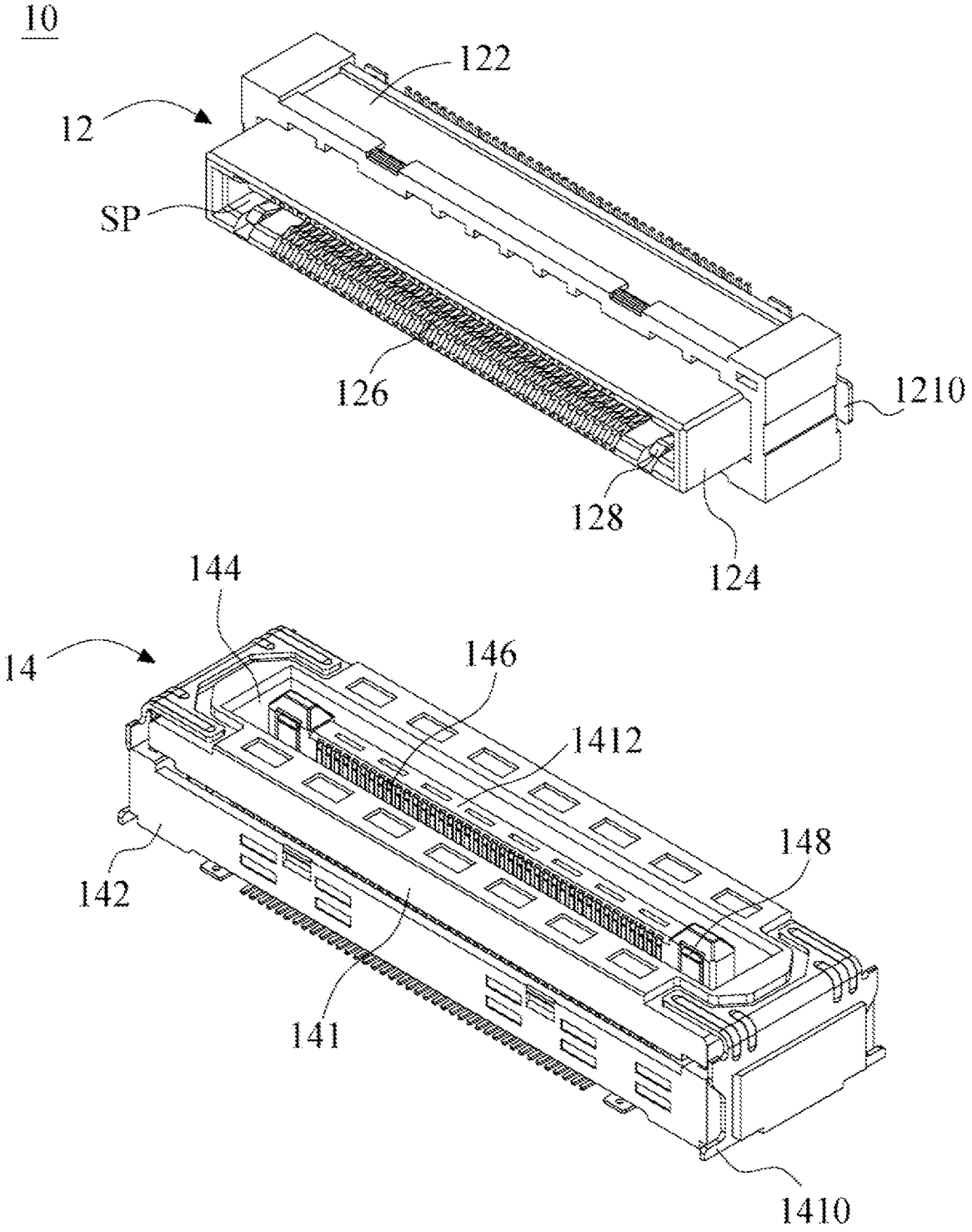
FIG. 1 is a perspective view of a floating connector with a power electrode structure in accordance with an embodiment of this invention.

With reference to FIG. 1 for the perspective view of a floating connector with a power electrode structure in accordance with an embodiment of the present invention, the floating connector with a power electrode structure 10 comprises a plug 12 and a socket 14. In an embodiment, the plug 12 is coupled to a first circuit board (not shown in the figure) and the socket 14 is coupled to a second circuit board (not shown in the figure). The first circuit board and the second circuit board can transmit signals and power between the first circuit board and the second circuit board after the plug 12 is inserted into the socket 14.

Figure 2:
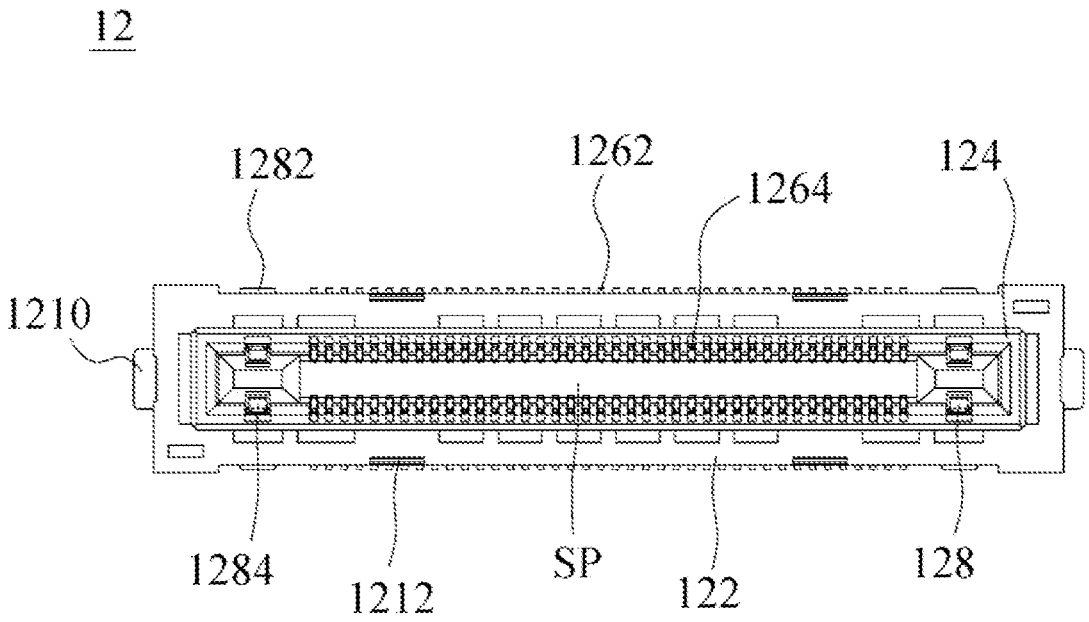
FIG. 2 is a top view of the plug with a power electrode structure of this invention as depicted in FIG. 1.
Figure 3:
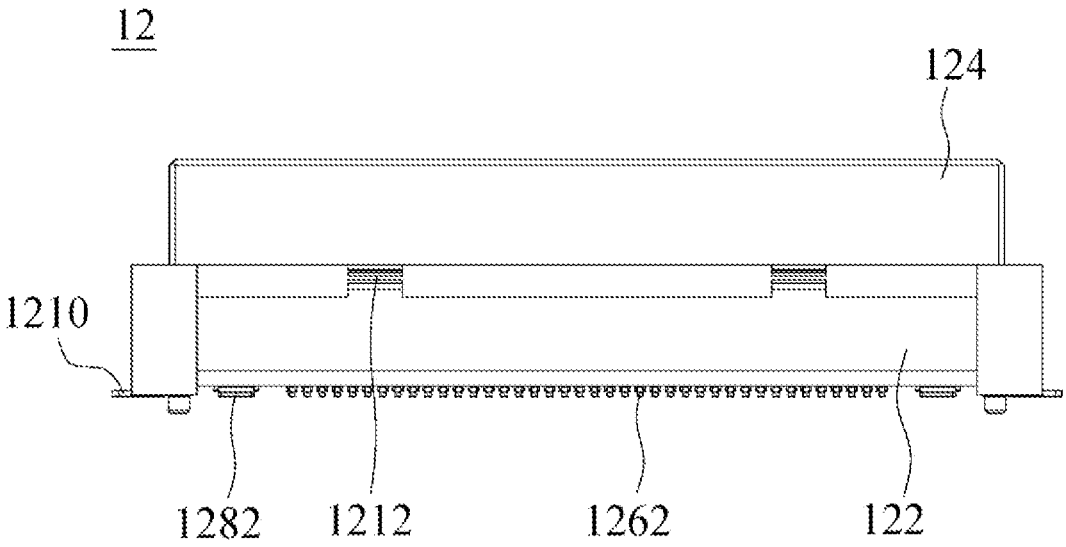
FIG. 3 is a side view of the plug with a power electrode structure of this invention as depicted in FIG. 1.

With reference to FIGS. 2 and 3 for the top view of the plug as depicted in FIG. 1 and the side view of the plug with power electrode structure as depicted in FIG. 1 respectively, the plug 12 comprises a plug base body 122, a connector 124, a first signal terminal group 126, a first power terminal group 128 and a fixing member 1210.

The plug base body 122 is coupled to the connector 124 to form an accommodating space SP. In this embodiment, the plug base body 122 and the connector 124 are long rectangular bodies, and in other embodiments, they can be of any other shape. The connector 124 is protruded from the plug base body 122. The connector 124 and the plug base body 122 are hollow bodies, so that the plug 12 can provide the accommodating space SP.

In another embodiment, the plug base body 122 further has engaging slot 1212 formed thereon and provided for installing a cover (not shown in the figure). In another embodiment, the engaging slot 1212 can be formed on the connector 124.

Figure 4:
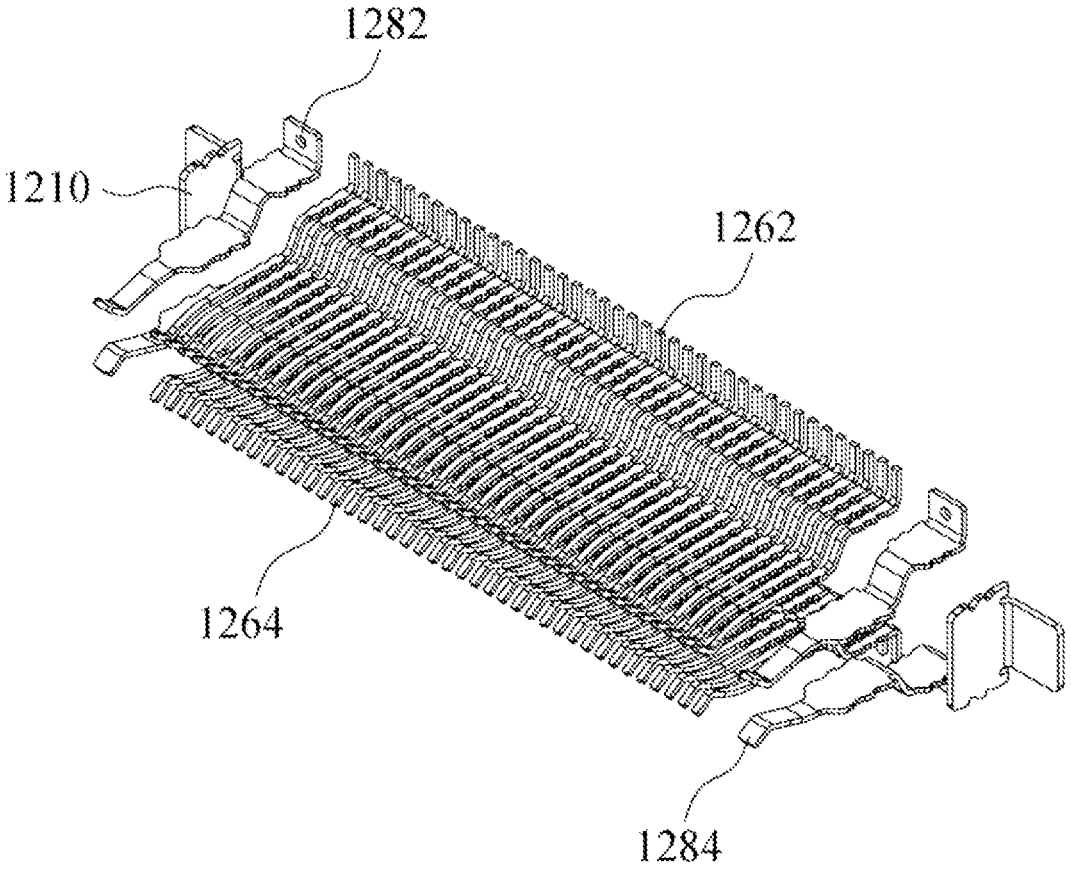
FIG. 4 is a perspective view showing the detailed structure of a first signal terminal group and a first power terminal group of the floating connector of this invention as depicted in FIG. 1.
Figure 5:
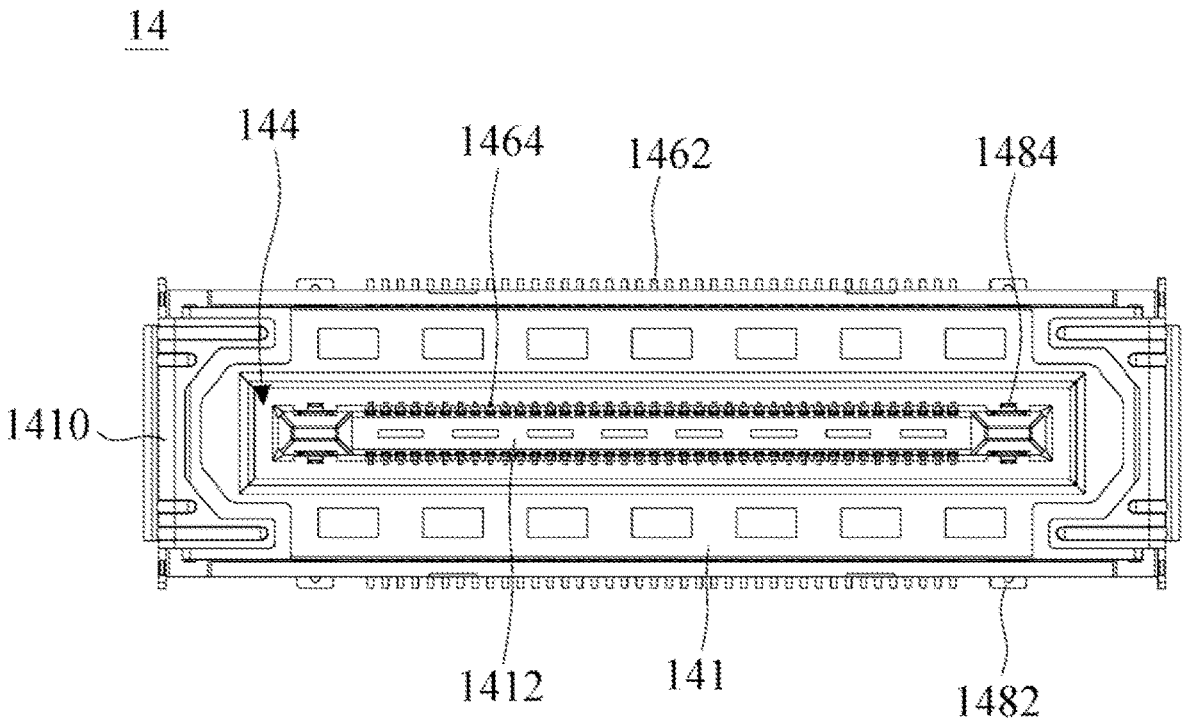
FIG. 5 is a top view of the socket of this invention as depicted in FIG. 1.
Figure 6:
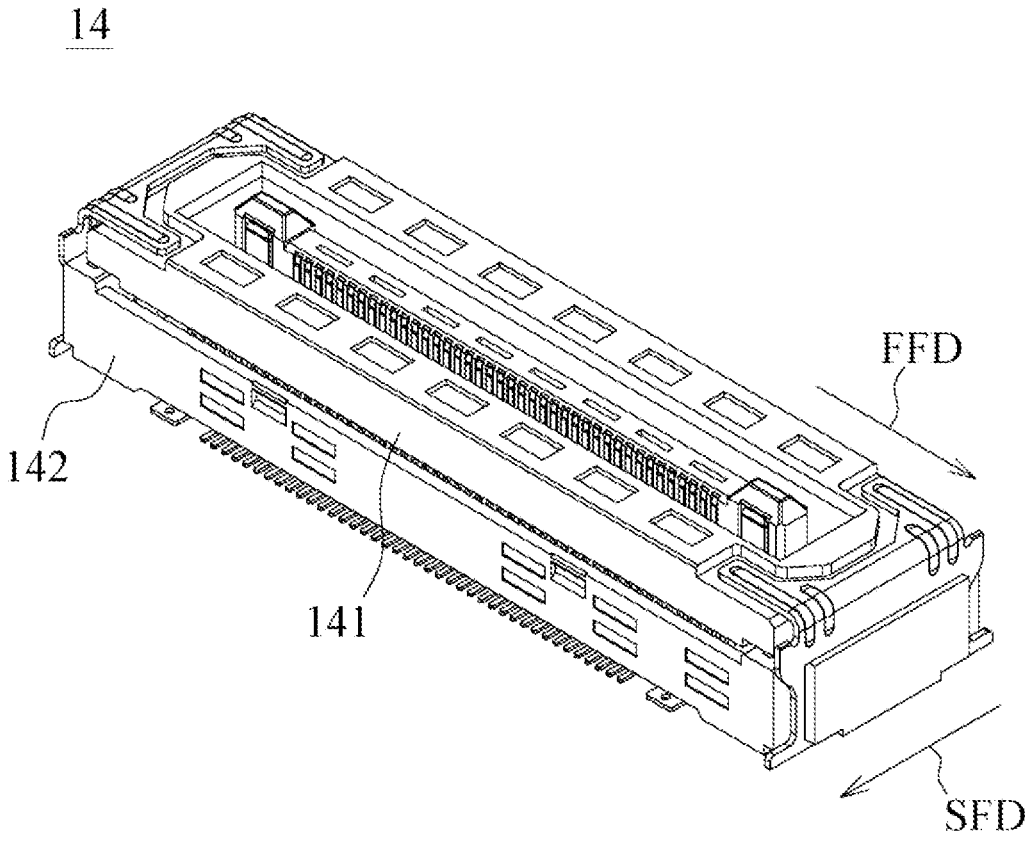
FIG. 6 is an oblique view of the socket of this invention as depicted in FIG. 1.

With reference to FIG. 4 for the perspective view showing the detailed structure of a first signal terminal group and a first power terminal group of the floating connector of this invention as depicted in FIG. 1, the first signal terminal group 126 and the first power terminal group 128 are installed at the periphery of the inner wall of the accommodating space SP. The first power terminal group 128 is installed on both sides of the first signal terminal group 126, and the fixing member 1210 is installed on both sides of the plug base body 122, so that the plug base body 122 can be installed on the first circuit board.

In addition, the first signal terminal group 126 further comprises a first terminal 1262 and a second terminal 1264, and the first terminal 1262 is coupled to the first circuit board for transmitting signals. The first power terminal group 128 further comprises a fifth terminal 1282 and a sixth terminal 1284. The fifth terminal 1282 is provided for coupling the first circuit board to receive power or ground. Wherein, the first signal terminal group 126 and the first power terminal group 128 have a plurality of signal terminals. In another embodiment, one of the power terminals of the first power terminal group is coupled to the fixing member.

In the accommodating space SP, the first power terminal group 126 and the first signal terminal group 128 are separated from each other with a distance to prevent the power from being interfered.

Figure 7:
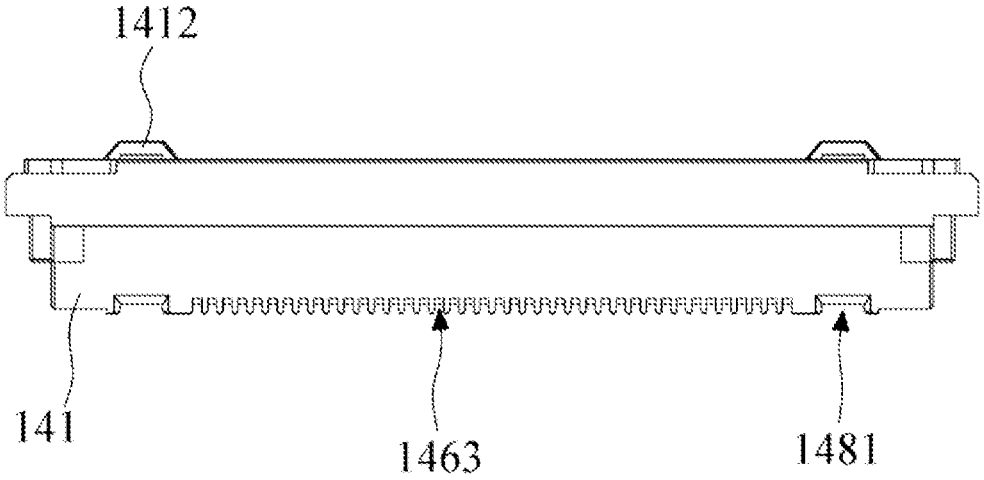
FIG. 7 is a side view of the socket of this invention as depicted in FIG. 1.
Figure 8:
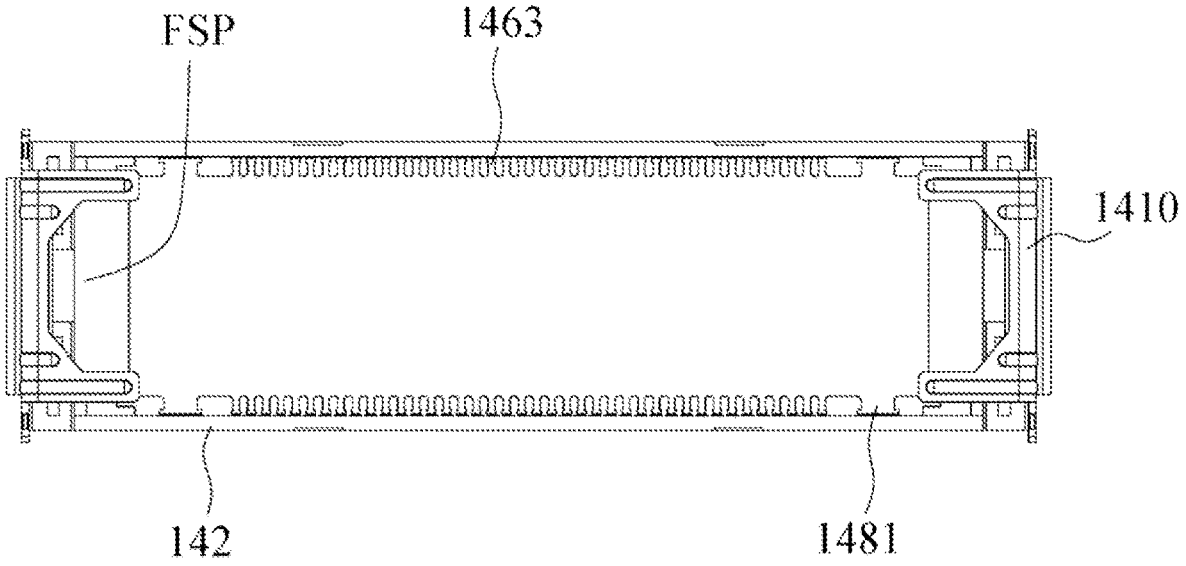
FIG. 8 is a top view of a socket lower shell of the socket of this invention as depicted in FIG. 1.
Figure 9:
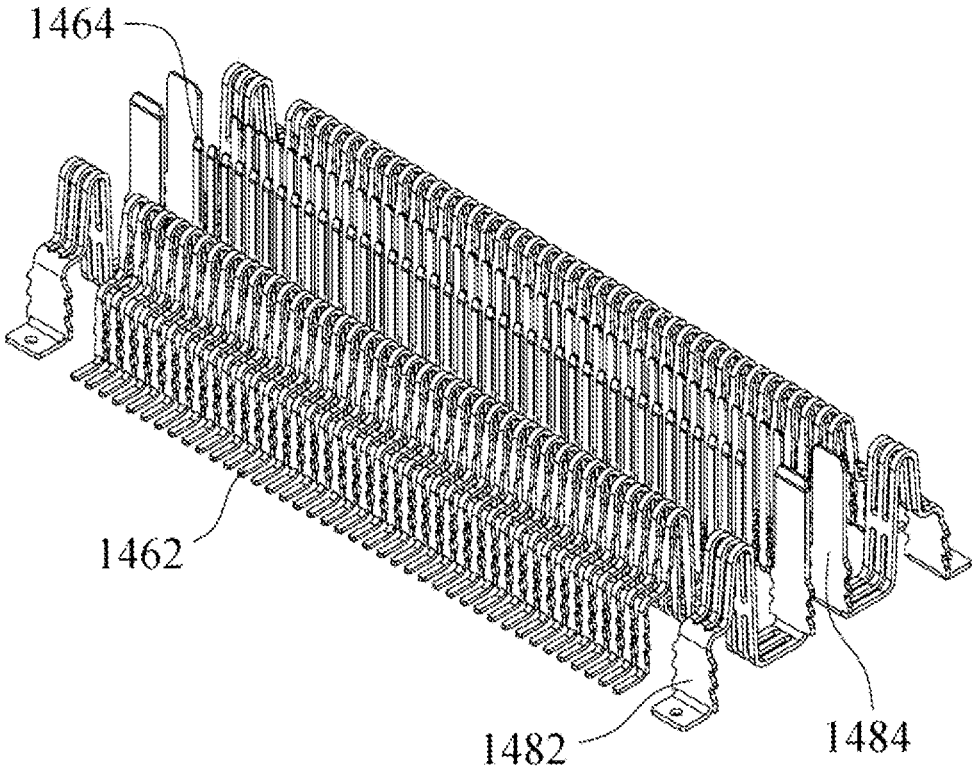
FIG. 9 is a perspective view showing the detailed structure of a second signal terminal group and a second power terminal group of the floating connector of this invention as depicted in FIG. 1.
Figure 10:
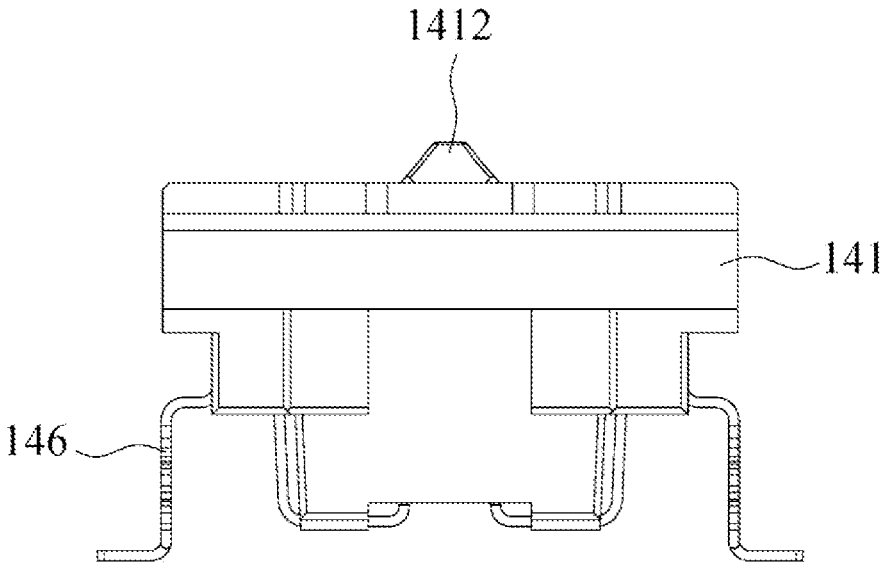
FIG. 10 is another side view of the socket of the present invention as depicted in FIG. 1.

In FIGS. 5 to 10, FIGS. 5 to 7 are the top view, the oblique view, and side view of the socket of the present invention as depicted in FIG. 1 respectively; FIG. 8 is the top view of a socket lower shell of the socket of the present invention as depicted in FIG. 1; FIG. 9 is the schematic view showing the detailed structure of a second signal terminal group and a second power terminal group of the socket of the present invention as depicted in FIG. 1; and FIG. 10 is the other side view of the present invention of the socket of the present invention as depicted in FIG. 1.

In FIG. 1, the socket 14 comprises a socket upper shell 141, a socket lower shell 142, a connecting groove 144, a second signal terminal group 146, a second power terminal group 148, a fixer 1410 and a tongue plate 1412.

The socket upper shell 141 is coupled to the socket lower shell 142. Wherein, the socket upper shell 141 is coupled to the socket lower shell 142, which is a long rectangular body, but it can be of any other shape in other embodiments, as long as it is corresponsive to the plug 12. In this embodiment, the socket upper shell 141 and the socket lower shell 142 produces a floating connection with the second signal terminal group 146. When the socket lower shell 142 is fixed, the socket upper shell 141 can be moved in both first direction FFD and second direction SFD, When the plug 12 is inserted into the socket upper shell 141 such that the second signal terminal group 146 produces a deformation, and thus can produce a floating movement at the socket upper shell 141 since it floats on the socket lower shell 142. In FIG. 8, the fixer 1410 drives the socket upper shell 141 to limit the position of the socket lower shell 142, so that the socket lower shell 142 can produce a floating space FSP corresponding to the socket upper shell 141.

In FIG. 7, the socket lower shell 142 has a signal terminal positioning slot 1463 formed thereon for positioning the second signal terminal group 146; and the socket lower shell 142 has a power terminal positioning slot 1481 formed thereon for positioning the second power terminal group 148.

The connecting groove 144 is configured to be corresponsive to the connector 124 of the plug 12. The connecting groove 144 is formed on the socket upper shell 141 for accommodating the tongue plate 1412.

In FIG. 9, the second signal terminal group 146 and the second power terminal group 148 are installed on both sides of the tongue plate 1412 respectively. The second signal terminal group 146 has a plurality of signal terminals, and the second signal terminal group 146 comes with an elastically deformed shape. The second signal terminal group 146 can be installed in a way as shown in FIG. 10.

The second signal terminal group 146 further comprises a third terminal 1462 and a fourth terminal 1464. The third terminal 1462 can be coupled to a second circuit board for transmitting signals, and the fourth terminal 1464 is electrically coupled to the second terminal 1264; and the second power terminal group 148 further comprises a seventh terminal 1482 and an eighth terminal 1484. The seventh terminal 1482 is provided for coupling the second circuit board, and the eighth terminal 1484 is electrically coupled to the sixth terminal 1284. Wherein, the second signal terminal group 146 has a plurality of signal terminals and the second power terminal group 148 has a plurality of power terminals. The second power terminal group 148 is configured to be corresponsive to the first power terminal group 128 and the second signal terminal group 146 is configured to be corresponsive to the first signal terminal group 126.

The fixer 1410 limits the position of the socket upper shell 141 to the socket lower shell 142. The fixer 1410 is a metallic part made of metal for improving the fixing strength.

After the plug 12 is inserted into the socket 14, the first signal terminal group 126 between the connector 124 and the connecting groove 144 is electrically coupled to the second signal terminal group 146, and the first power terminal group 128 is electrically coupled to the second power terminal group 148 for transmitting power and signals.

What is claimed is:

1. A floating connector with a power electrode structure, comprising:

a plug, comprising a plug base body, a connector, a first signal terminal group, a first power terminal group and a fixing member, wherein the plug base body is coupled to the connector to form an accommodating space, and the first signal terminal group and the first power terminal group are installed at the periphery of the inner wall of the accommodating space, and the first power terminal group is installed on both sides of the first signal terminal group, and the fixing member is provided for installing the plug base body to a first circuit board; and a socket, comprising a socket upper shell, a socket lower shell, a connecting groove, a second signal terminal group, a second power terminal group, a fixer and a tongue plate, wherein the socket upper shell is coupled to the socket lower shell, and the connecting groove is configured to be corresponsive to the connector, and the connecting groove is formed on the socket upper shell for accommodating the tongue plate, and the second signal terminal group and the second power terminal group are installed on both sides of the tongue plate respectively, and the fixer is provided for limiting the position of the socket upper shell to the socket lower shell, and the second signal terminal group between the socket upper shell and the socket lower shell is deformed towards at least one direction selected from a first direction and a second direction to produce a movement of the socket upper shell and/or the socket lower shell;

wherein, when the plug is inserted into the socket, the first signal terminal group is electrically coupled to the second signal terminal group and the first power terminal group is electrically coupled to the second power terminal group, between the connector and the connecting groove, for transmitting power and signals;

wherein the fixer limits the position of the socket upper shell to the socket lower shell, so that the socket lower shell produces a floating space corresponding to the socket upper shell.

2. The floating connector with a power electrode structure as claimed in claim 1, wherein the first signal terminal group further comprises a first terminal and a second terminal, and the first terminal is provided for coupling the first circuit board to transmit signals; and the second signal terminal group further comprises a third terminal and a fourth terminal, and the third terminal is provided for coupling a second circuit board to transmit signals, and the second terminal is electrically coupled to the fourth terminal.

3. The floating connector with a power electrode structure as claimed in claim 1, wherein the first power terminal group further comprises a fifth terminal and a sixth terminal, and the fifth terminal is provided for coupling the first circuit board to receive power or ground; and the second power terminal group further comprises a seventh terminal and an eighth terminal, and the seventh terminal is provided for coupling a second circuit board, and the sixth terminal is electrically coupled to the eighth terminal.

4. The floating connector with a power electrode structure as claimed in claim 1, wherein the plug base body or the connector further comprises an engaging slot for installing a cover.

5. The floating connector with a power electrode structure as claimed in claim 1, wherein the first power terminal group and the first signal terminal group in the accommodating space have a distance apart from one another, and the second power terminal group is configured to be corresponsive to the first power terminal group and the second signal terminal group is configured to be corresponsive to the first signal terminal group.

6. The floating connector with a power electrode structure as claimed in claim 1, wherein the socket lower shell has a signal terminal positioning slot formed thereon for positioning the second signal terminal group; and, the socket lower shell has a power terminal positioning slot formed thereon for positioning the second power terminal group.

* * * * *